United States Patent [19]

Dupuy

[11] 4,381,112

[45] Apr. 26, 1983

[54] GAME APPARATUS

[76] Inventor: Stanley T. Dupuy, 79 Marie Dr., Gretna, La. 70053

[21] Appl. No.: 283,439

[22] Filed: Jul. 15, 1981

[51] Int. Cl.[3] ..... A63F 3/00; G09F 9/00

[52] U.S. Cl. ..... 273/239; 273/281; 273/271; 40/449; 40/488

[58] Field of Search ..... 273/239, 281, 271; 46/239, 240; 40/449, 110, 488

[56] References Cited

U.S. PATENT DOCUMENTS

| | | | |
|---|---|---|---|
| 3,012,787 | 12/1961 | Ertel | 273/281 X |
| 3,827,168 | 8/1974 | Mori | 40/110 |
| 3,995,386 | 12/1976 | Salam | 40/449 |
| 4,141,561 | 2/1979 | Spitzner | 273/271 |
| 4,243,227 | 1/1981 | Strongin | 273/357 |
| 4,277,067 | 7/1981 | Gettleman | 273/271 |

*Primary Examiner*—Richard C. Pinkham
*Assistant Examiner*—Scott L. Brown
*Attorney, Agent, or Firm*—Dority & Flint

[57] ABSTRACT

A game apparatus is disclosed as including a vertical game board A having two playing faces 10 and 12 which includes a plurality of windows 12 and 14. A pair of color coded game playing pieces 30 and 32 is held completely captive in individual compartments B between the playing faces which are movable by manipulation of a hand device in and out of the window position to produce a game winning color pattern on the faces. Playing piece 30 includes magnetic material and device C includes a magnet by which pieces 30 and 32 are moved into the window position. All pieces may be simultaneously returned to a start position by tilting the game board.

11 Claims, 7 Drawing Figures

GAME APPARATUS

BACKGROUND OF THE INVENTION

Heretofore, many game playing devices and boards have been constructed to provide challenging entertainment for the players. Many of these devices include a board having a playing surface on which game playing pieces are moved in a strategic pattern on the playing board according to the rules of the game. Some of these games have included game boards in which the game playing pieces are integral with the board rather than separated, loose pieces. For example, U.S. Pat. No. 4,141,561 discloses a game card assembly which includes a horizontal game card which provides a horizontal playing surface with windows in which movable game pieces are moved to play the game.

Another prior game utilizes a vertical playing board in which checkers are contained inside a grid and closed therein by means of an unsecured underslung gate. However, the gate often opens inadvertently discharging the checkers which require that the game be replayed. After the game is played, the checkers must be manually separated by color and the loss of checkers can render the game worthless or cause added expense to replace lost checkers. The players must individually place checkers in the grid, and the player breaks his concentration when he turns away from the game board to procure additional checkers.

Accordingly, an important object of the present invention is to provide a game playing apparatus which includes a vertical game playing board having two playing faces on which the game is played from opposite sides of the board in which the loss of game playing pieces is eliminated by making the playing pieces completely captive within the game board.

Another important object of the present invention is to provide a game apparatus having a vertical game board which includes two playing faces having a plurality of windows arranged therein in a predetermined array wherein captive elements are played within by manipulation from outside the game board.

Another important object of the present invention is to provide a game apparatus having a vertical game board which utilizes novel game playing pieces and a tool device for moving the pieces which are completely captive within the game board.

Prior vertical game boards require one marker to support the marker immediately above and so on to achieve total game board occupation. The game board, according to the invention, permits markers to be played anywhere in the game board and does not require other markers for vertical support and/or pattern formation.

SUMMARY OF THE INVENTION

The objectives are accomplished according to the present invention by providing a game board having a first playing face on one side and a second playing face on the opposite side wherein each face includes a plurality of aligned window openings arranged in a game playing array wherein individualized compartments are formed between the playing faces within the game board for each window in which a playing piece is completey enclosed and held captive.

Another important feature of the present game board invention is that "T" formations can be formed in two (2) sizes depending on the attitude in which "T's" are formed. Contemporary games nor game boards do not offer this unique variability. A tool device for moving the playing pieces includes a handle portion and a head portion which moves the playing pieces. In a preferred embodiment, the tool head includes a magnet, a firt color coded playing piece which is magnetic and a second color coded piece are nested together in each compartment. The two pieces are moved together in their nested configuration to place the first marker and color before a window and the first magnetic piece is retracted to expose and play the second piece and color before the window.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
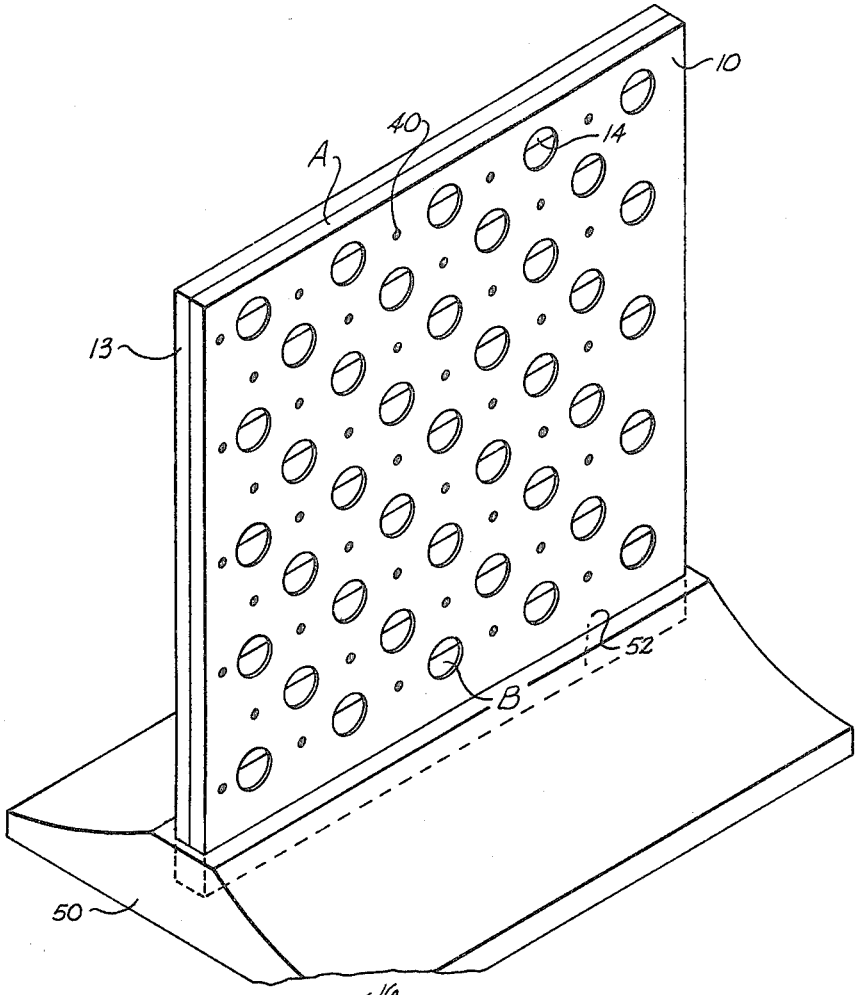
FIG. 1 is a perspective view illustrating game apparatus constructed according to the invention.

As illustrated in the drawing, game apparatus according to the present invention is illustrated as including a game board A which includes a first game playing face on one side thereof and a second game playing face on an opposite side of the game board. Each of the game playing faces includes a plurality of windows arranged in designed array according to which the game is played. A plurality of game playing pieces occupy the windows as moved and positioned by a player. Individualized compartment means B is formed between the first and second playing faces of the game board for maintaining the playing pieces captive and retaining the pieces during playing in a concealed or an exposed position before one of the windows. Stop means are carried in the compartment means for limiting position of the playing pieces between first and second limit positions and further individualizing the compartments for a single playing piece. The playing pieces are exposed within a window in the second position and concealed when in the first position. The playing pieces include a first playing piece having a first color code and a second playing piece having a second color code different from the first color code which may be moved within the compartment and window so as to be visually perceived behind the window from either playing face. Means C is provided for manually moving the game pieces between the first and second positions from outside the game board to fill a preselected window and establish a winning color pattern in the design array on both playing faces simultaneously.

Figure 3:
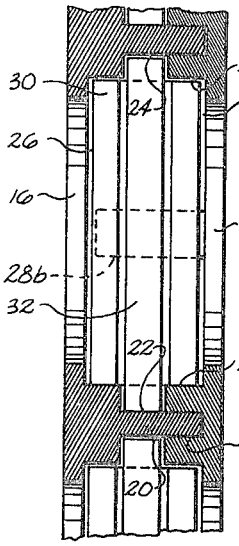
FIG. 3 is an end sectional view of FIG. 5.
Figure 5:
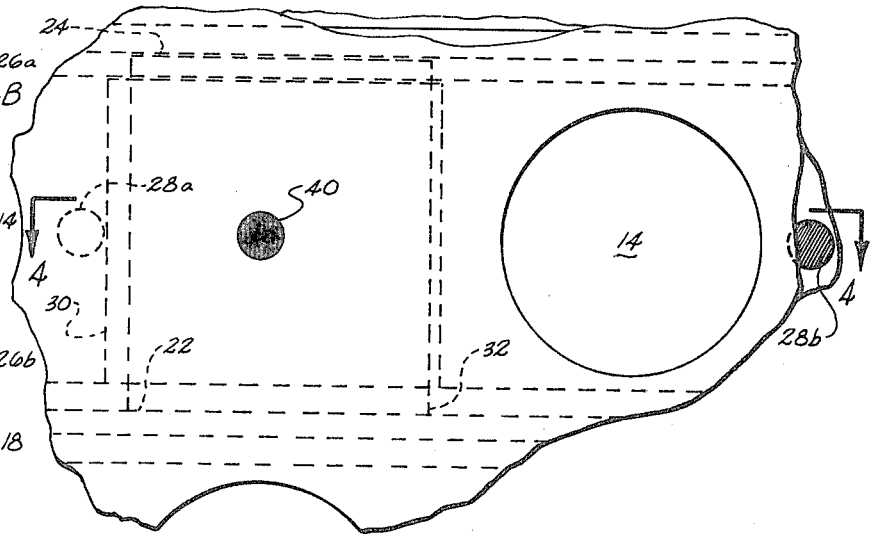
FIG. 5 is a partial elevation view illustrating one playing compartment and window for a game board constructed according to the present invention.
Figure 4:
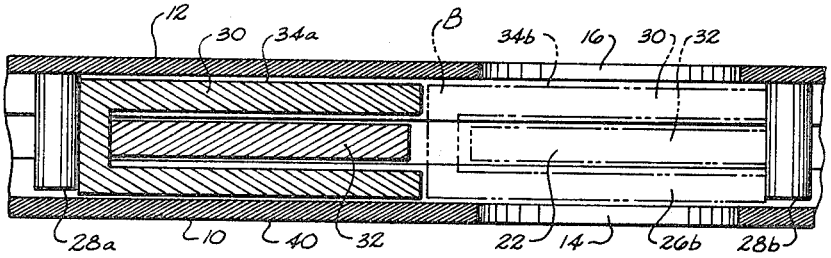
FIG. 4 is a top sectional view taken along line 4—4 of FIG. 5.
Figure 6:
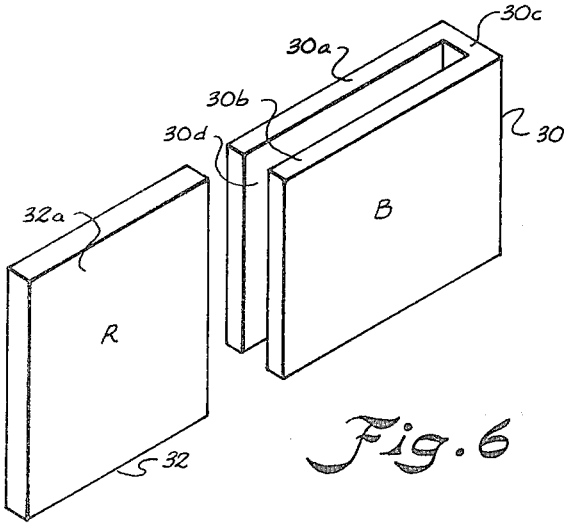
FIG. 6 is a perspective view illustrating the game playing pieces constructed according to the present invention.
Figure 7:
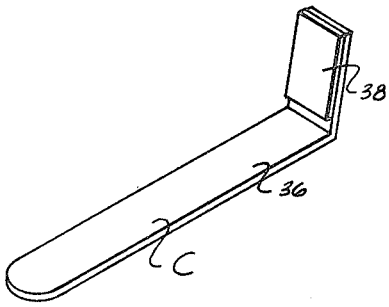
FIG. 7 is an elevation illustrating a game tool device for moving the game playing pieces of game apparatus according to the present invention.

Referring now in more detail to the drawing, the game board A is illustrated as including a first playing face 10 and a second playing face 12 on opposing sides of the game board, each of which includes a plurality of window openings 14 and 16, respectively. The game playing faces 10 and 12 may be constructed of any suitable material such as a plastic and glued together internally by means of a glue socket 18 and a rail projection 20 carried by faces 10 and 12, respectively, which fit together. As is best illustrated in FIG. 3, the rail 20 provides a bottom surface of a groove 22 and the top surface of a groove 24 in which a first playing piece is slidably carried. The grooves 22 and 24 open into a compartment bore 26 having top shoulder surfaces 26*a* and bottom shoulder surfaces 26*b* which slidably carry a second playing piece as will be more fully hereinafter explained.

Stop means for limiting the movement of the playing pieces between first and second limit positions is provided within compartment means B by stops 28*a* and 28*b* extending across the width of each compartment.

As illustrated, player piece 30 is color coded in a first color which may be black and playing piece 32 is color coded in a second color such as red. An individual pair including one each of piece 30 or 32 is included in each compartment B and held captive therein as illustrated. The first playing piece 30 is preferably formed as having a general U-shaped cross section defined by two opposing legs 30*a* and 30*b* and a third leg 30*c* which bridges and forms a solid back between the legs 30*a* and 30*b*. An open front 30*d* is thus defined which receives the red playing piece 32 in a nested configuration between the opposed legs. The playing pieces are nested within each other and occupy the full line position 34*a* shown in the compartment means B when in the first position abutting stop 28*a*. Playing piece 32 is in the form of a flat playing piece having generally square side at 32*a*. The playing piece 32 is taller than piece 30 and extends between the bottom groove 22 and top groove 24 of compartment means B such that the red piece slides therein. The black piece rests on bottom shoulders 26*b* of compartment bore 26 and slides thereon as best seen in FIG. 3.

Means C for manually moving the playing pieces between the first and second positions is preferably provided by making playing piece 30 as to include magnetic material and providing a tool device in the form of a handle portion 36 and magnetic head 38. The playing piece 30 may thus be moved by placing the magnetic head of the tool device adjacent the exterior of either playing face 10 or 12 and moving the magnetic head in the direction in which is desired to move the piece 30. To move a black piece, where piece 30 and 32 are nested at the full line position 34*a*, the player playing the black piece from face 10 moves the black piece to the right by placing the head 38 of the tool at the circle indicated at 40 on the game board face and commencing movement thereof. Moving the tool to the right, as viewed from face 10, will move the black piece and nested red piece to the right where the black piece occupies and is visible in the window from both faces of the game board, dotted line position 34*b*. It will be noted that the red piece will not be visible since it is concealed between the legs 30*a* and 30*b* of the black piece. In order to move a red piece, the player playing the red face of the board places the magnetic head 38 at the circle on the red playing face 12 and moves the nested playing pieces 30 and 32 from the full line position 34*a* to the window position 34*b* abutting the stop 28*b*. The black piece is then returned to the full line position shown at 34*a* by moving the magnetic head back to the right which leaves the red piece 32 occupying the window. In this manner, there is no accidental moving of the wrong marker as in the case where two separate magnetic pieces are utilized.

Following termination of a game, the playing pieces in the window positions may be simultaneously returned to the start or concealed position by tilting the board on its side 13. Thus, the checkers are prevented from being lost while being returned and do not require individual resetting for a new game.

Game board A is supported in an upright or vertical position by base 50, FIG. 1. The bottom of gameboard A is inserted in slot 52 of base 50, and/or removed for storage by lifting same from socket 52.

Figure 2:
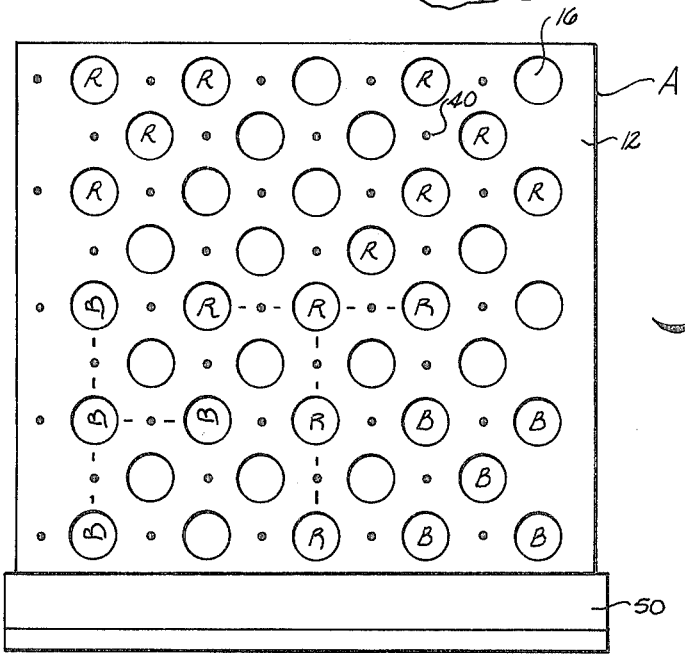
FIG. 2 is a front elevation of game apparatus constructed according to the present invention illustrating the opposite side and playing face of the game board which is identical.

Winning patterns are established on the game board by forming red or black regular "T"s as shown in the left upper corner of FIG. 2 which consists of three red markers in a straight line and a perpendicular marker off of the middle marker. Super "T"s are formed by two markers perpendicular to the middle marker for a total of five markers (right upper corner). Multiple "T"s in one formation may also be formed as the four black "T"s in the right lower corner of FIG. 2. "T"s may be upright, upside down, or on a diagonal and may be interconnected in a number of different arrangements. Additional Super "T's" are shown connected by dotted lines. Points and scores are made according to rules for the various formation.

While a preferred embodiment of the invention has been described using specific terms, such description is for illustrative purposes only, and it is to be understood that changes and variations may be made without departing from the spirit or scope of the following claims.

What is claimed is:

1. Game apparatus for playing a game comprising:

a game board having first and second game playing faces on opposite sides thereof;

each of said game playing faces having a plurality of windows opposing one another from opposite sides of said game board;

a plurality of game playing pieces;

said plurality of playing pieces including first and second color coded playing pieces of different colors either of which may be moved into said window;

compartment means defined between said first and second faces for maintaining a pair of said playing pieces captive and retaining said pieces during playing in a concealed or an exposed window position between opposing windows, said pair consisting of one each of said first and second playing pieces;

means for individually moving and positioning said color coded pieces in said window position wherein said piece is visible; and means containing each said pair of playing pieces for movement in each said compartment between said concealed and exposed positions so that all of said playing pieces in all of said compartments may be simultaneously returned from said exposed position to said concealed position upon tilting of said game board toward a side rotated position.

2. The apparatus of claim 1 including a tool device for moving said playing pieces having a handle for being manually held and a head portion for effecting movement of said playing pieces.

3. The apparatus of claim 2 wherein at least one of said playing pieces includes magnetic material and said head portion includes a magnet which cooperates with said magnetic section to move said playing piece.

4. The apparatus of claim 1 wherein said first playing piece includes a generally U-shaped piece having opposed legs being open therebetween and said second playing piece has a complementary cross section and is received within said opposed legs of U-shaped section and concealed therein when said first piece is in said window position while said second piece is visible when said first piece is moved in a reverse direction thereby displaying said second piece in said window portion.

5. The apparatus of claim 4 wherein at least said first piece includes magnetic material and said means for moving said playing pieces includes a manual tool device having a magnet carried therein.

6. The apparatus of claim 1 including base means for supporting said game board in an upstanding configuration.

7. Game apparatus for playing a game comprising:

a game board which includes a first game playing face on one side and a second game playing face on an opposite side of said game board;

each of said first and second game playing faces having a plurality of windows arranged in a designed array according to which the game is played;

a plurality of game playing pieces;

individualized compartment means formed between said first and second faces of said game board for maintaining a pair of said playing pieces in captive form and retaining said pieces during playing in either a concealed or an exposed window position before one of said windows;

said pair of playing pieces being both concealed on a common side of said compartment means in said first position;

stop means carried by and separating adjacent compartment means for limiting the position of each said playing piece in each said compartment means between first and second limit positions therein;

said playing pieces being exposed before one of said windows in said second position and being normally concealed when in said first position;

said playing pieces including a first playing piece having a first color code and a second playing piece having a second color code different from said first color code, said pair consisting of one each of said playing pieces carried in each said compartment means;

means for manually moving said first and second pieces between said first and second positions from outside said compartment means and playing faces to fill a preselected window so as to establish a desired pattern of color coded windows in said design array to accomplish a winning pattern on said playing faces.

8. The apparatus of claim 7 wherein said first color coded section of each said playing piece includes a three-leg piece having a generally U-shaped cross section defined by opposing legs being opened at one end and integrally joined adjacent the other end by a third leg bridging said opposed legs and said second color coded section includes a generally square section piece which is complementary to and received between the opposed legs of said first section and normally concealed therein.

9. The apparatus of claim 8 wherein said first section includes a portion of magnetic material and said second section piece is constructed from a non-magnetic material, wherein said means for moving said pieces includes a tool device having a magnetic head portion which moves said first color coded section piece by manipulation of said tool device adjacent the exterior of said playing faces.

10. The apparatus of claim 9 wherein said second section piece is moved to said second position by first moving said first color coded section piece to said second position and retracting said first color coded section piece to said first position whereby said second color coded piece remains in said second position.

11. The apparatus of claim 7 wherein said first playing piece includes magnetic material and said second playing piece consists entirely of nonmagnetic material, said means for moving said pieces includes a magnet tool.

* * * * *